US007753375B1

(12) United States Patent
Neal et al.

(10) Patent No.: US 7,753,375 B1
(45) Date of Patent: Jul. 13, 2010

(54) AMUSEMENT BALL RECEIVING AND RETURN

(75) Inventors: Phillip H. Neal, San Rafael, CA (US); Nathan Keker, Oakland, CA (US)

(73) Assignee: Diggin Active, Inc., Emeryville, CA (US)

( * ) Notice: Subject to any disclaimer, the term of this patent is extended or adjusted under 35 U.S.C. 154(b) by 169 days.

(21) Appl. No.: 12/176,968

(22) Filed: Jul. 21, 2008

(51) Int. Cl.
*A63F 7/20* (2006.01)

(52) U.S. Cl. ..... 273/317.3; 273/317

(58) Field of Classification Search ..... 273/317, 273/317.1, 317.3; 124/4, 6
See application file for complete search history.

(56) References Cited

U.S. PATENT DOCUMENTS 5,492,334 A * 2/1996 Carignan et al. ..... 273/399
6,443,859 B1 * 9/2002 Markin ..... 473/451
6,663,108 B2 * 12/2003 Makhoul ..... 273/317.3
6,772,745 B2 * 8/2004 McEachen et al. ..... 124/6
7,611,146 B2 * 11/2009 Arden ..... 273/317
2007/0284824 A1 * 12/2007 Arden ..... 273/317

* cited by examiner

*Primary Examiner*—Raleigh W. Chiu
(74) *Attorney, Agent, or Firm*—Michael E. Woods

(57) ABSTRACT

An amusement system including a housing having a receiving aperture at a top surface and an ejecting aperture at a front surface and further including a channel connecting the receiving aperture to the ejecting aperture; a motorized rotatable flywheel mounted inside the housing and coupled to the channel between the top surface and the channel for engaging an object travelling through the channel; a roller assembly mounted inside the housing and coupled to the channel opposite of the flywheel and disposed so an object engaging the flywheel concurrently engages the roller assembly wherein the flywheel and the roller assembly cooperatively eject the object a distance less than fifteen feet from the ejecting aperture when the flywheel rotates and contacts the object; and wherein the housing includes a mounting system to attach to an object no less than about three feet above a surface supporting the object.

22 Claims, 5 Drawing Sheets

AMUSEMENT BALL RECEIVING AND RETURN

BACKGROUND OF THE INVENTION

The present invention relates generally to amusement systems, and more specifically to a basketball themed toy particularly adapted for indoor use and suitable for young children.

There are many training systems for athletic activities. There are baseball, basketball, and tennis trainers that will mechanically operate on the ball so a person may learn to hit or shoot the ball. These systems are designed for real balls and are generally used in the context of the full-size court or batting cage. These trainers are generally designed to accurately simulate some relevant element of the sport, most often for adults or mature children.

In the amusement/toy industry, there is a desire to provide a young adult or child with some of the visual/auditory aspects of participating in an "adult" game while focusing on safety and "fun" for these participants. Additionally, cost of the item, particularly as a "toy" is a factor with the device needing to reproduce much of the environment as cost effectively and safely as possible while trying to maximize play aspects. All in the context of young adults/children as participants.

The safety does not relate only to physical safety of the children, but also to safety of the environment of the amusement device as these devices are preferably used indoors of a participant's home, such as a bedroom, den, living room, playroom, or office. Full-sized, full-powered trainers are not suitable for young children or use in these environments.

What is needed is a amusement system that safely simulates some of the flavor and action of participating in a basketball-type activity indoors.

BRIEF SUMMARY OF THE INVENTION

Disclosed is an amusement system and method adapted for indoor use, most preferably for young adults and children though people of all ages may use and enjoy embodiments of the present invention. An amusement system includes a housing including a receiving aperture at a top surface and an ejecting aperture at a front surface and further including a channel connecting the receiving aperture to the ejecting aperture; a motorized rotatable flywheel mounted inside the housing and coupled to the channel between the top surface and the channel for engaging an object travelling through the channel; a roller assembly mounted inside the housing and coupled to the channel opposite of the flywheel and disposed so an object engaging the flywheel concurrently engages the roller assembly wherein the flywheel and the roller assembly cooperatively eject the object a distance less than fifteen feet from the ejecting aperture when the flywheel rotates and contacts the object; and wherein the housing includes a mounting system to attach to an object no less than about three feet above a surface supporting the object.

This system and method provides safe simulation of some of the flavor and action of participating in a basketball-type activity indoors. A safety ball that is small and soft (e.g., foam) is patterned to look like a scale version of a regulation basketball. A backboard and net are provided that may help in well-known fashion to receive the safety ball within a housing that includes an ejecting system adapted to eject the safety ball from a front aperture of the housing. The combination of a safety ball being ejected from a housing mounted off the floor so it does not include substantial upward component (to reduce risk of being hit in the face) and a lower velocity to be less than fifteen feet (most preferably six to ten feet). The system and method also preferably include an ejectment system that substantially immediately ejects the safety ball when it is received in the housing. (This is contrasted to many training systems which intentionally provide predetermined delays from receipt of the ball in the housing and its ejectment.) Further, there is provided a feedback system that may help direct play and provide suitable environmental sounds and visual effects.

DETAILED DESCRIPTION OF THE INVENTION

The present invention provides an apparatus and method for an interactive toy that provides new structures and combinations of features for enhancing education and amusement, particularly for an amusement system providing safe simulation of some of the flavor and action of participating in a basketball-type activity indoors for young adults and children. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
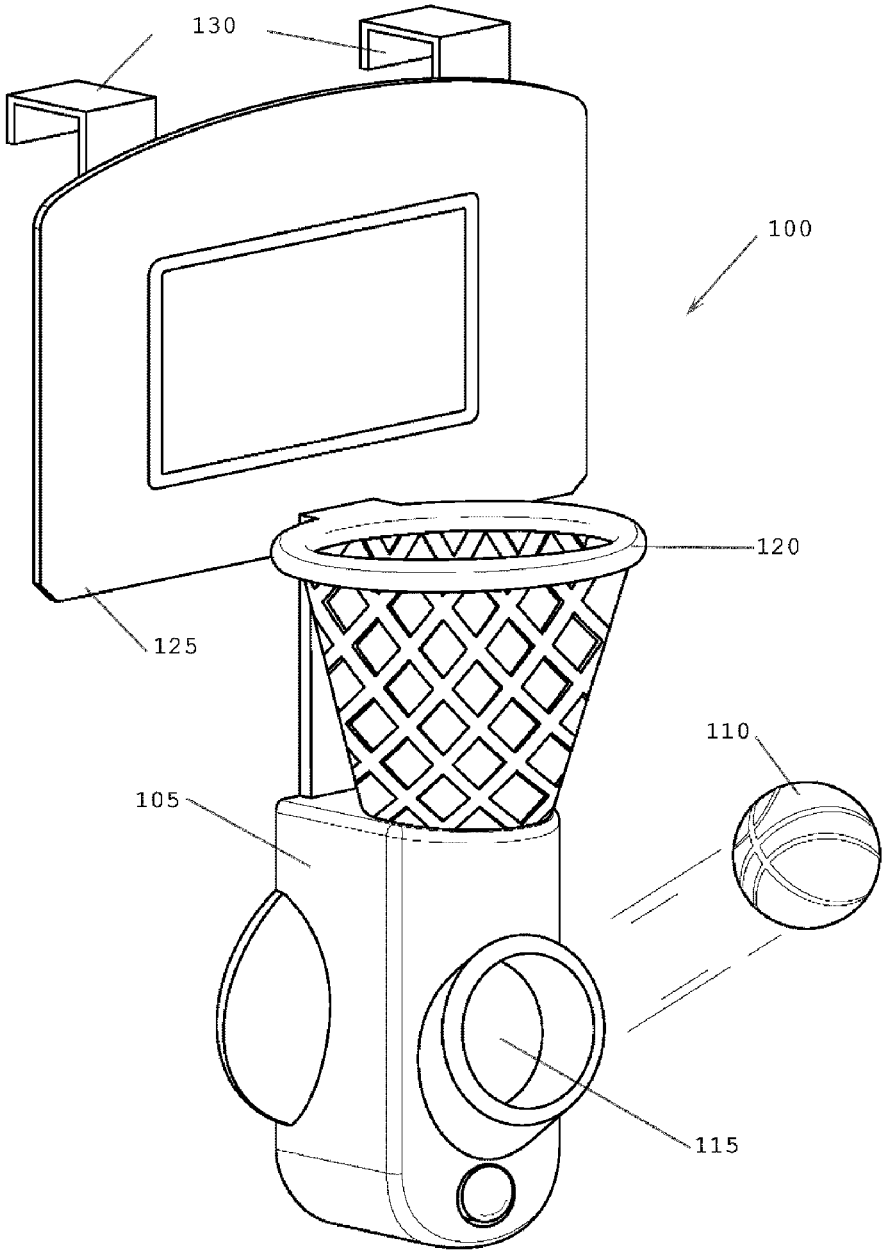
FIG. 1 is a perspective diagram of an embodiment of the present invention for an amusement device.

FIG. 1 is a perspective diagram of an embodiment of the present invention for an amusement device 100. Device 100 includes a housing 105 that receives and ejects a safety ball 110 from an front ejecting aperture 115. A net 120 cooperates with a backboard 125 to help direct safety ball 110 into a top aperture in housing 105. A mounting system 130 suspends housing 105 above a play surface, such as by hanging from a door. Preferably housing 105 is suspended at least three feet above the play surface but the height is adjustable to adapt to preferences and children size. Some of the safety features of device 100 include protection for user safety as well as for helping to prevent damage to other objects in the play area. Since device 100 is adapted to be useable indoors in a living room, bedroom, office, den, or other such area, safety ball 110 is soft foam or similar material. Additionally, it is preferable that the ejecting velocity is such to avoid injury should safety ball 110 be directed to the face of the child. Since device 110 is designed to have fast action, these safety features are important. Fast action is achieved in part by not intentionally introducing any delay into the time that safety ball 110 enters housing 105 and when it is ejected from aperture 115.

The ejecting velocity (speed and angle) is preferably adjusted so that safety ball 110 does not shoot beyond six to ten feet. Part of the reason that this is variable is that housing 105 is preferably mounted/suspended above the play surface.

While it is desirable that the ejecting velocity not have any significant upward component, should housing 110 be mounted high relative to the height of the children, there could be instances in which safety ball 110 could be ejected directly into a face of a participant. Hence safety ball 110 being of soft material and the ejecting speed being low enough to not pose risk of injury in this circumstance.

Figure 2:
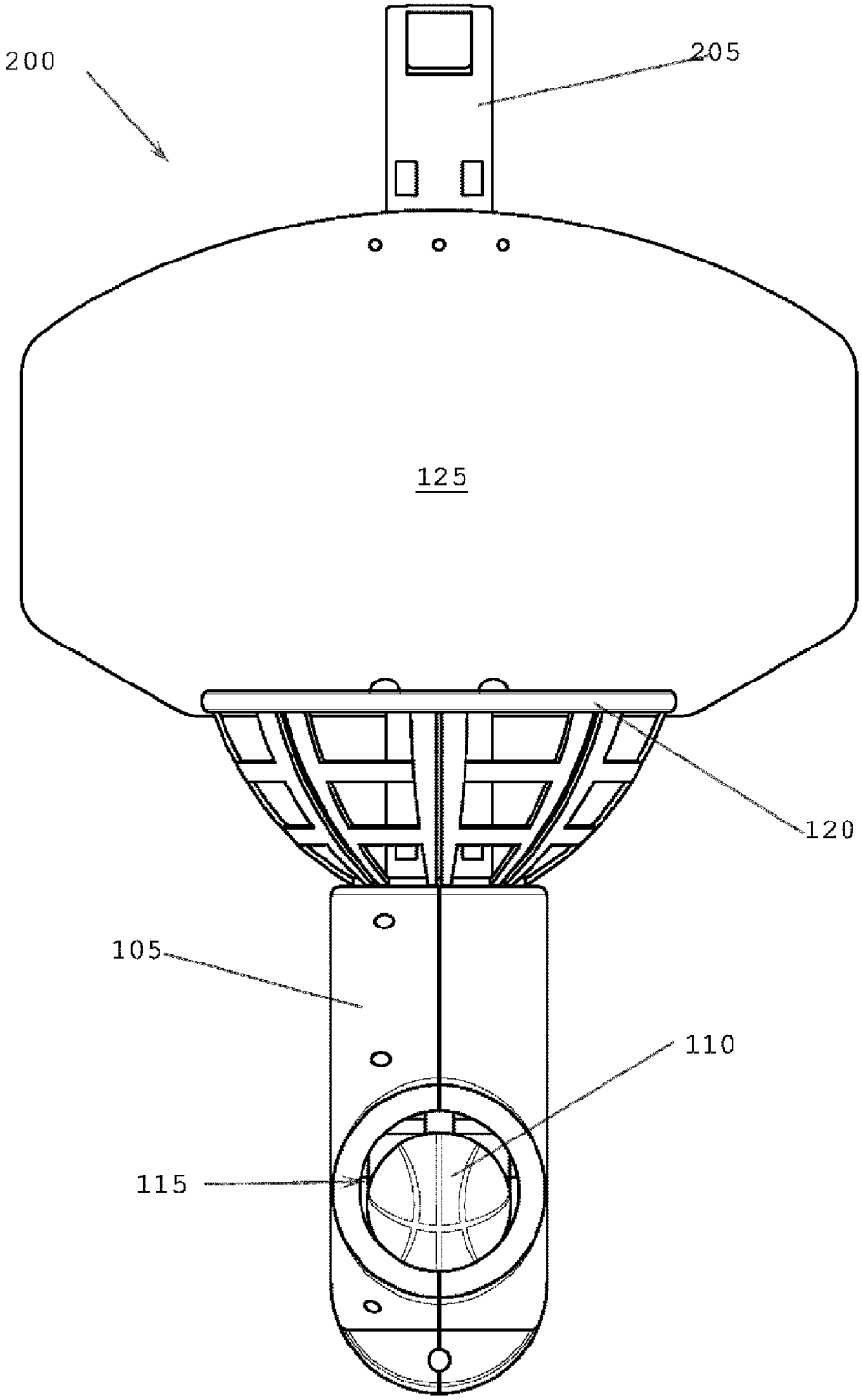
FIG. 2 is a front view of an embodiment of the present invention for a slightly varied embodiment of the amusement device shown in FIG. 2.

FIG. 2 is a front view of an embodiment of the present invention for a slightly varied embodiment of the amusement device shown in FIG. 2. An amusement system 200 includes a single point mounting system 205 in contrast to the double mount 130 shown in FIG. 1. Either mount system is workable and may be used based upon implementation design considerations. In other respects, the components of system 200 are the same as the components, except when specifically different with respect to the mounting systems.

Figure 3:
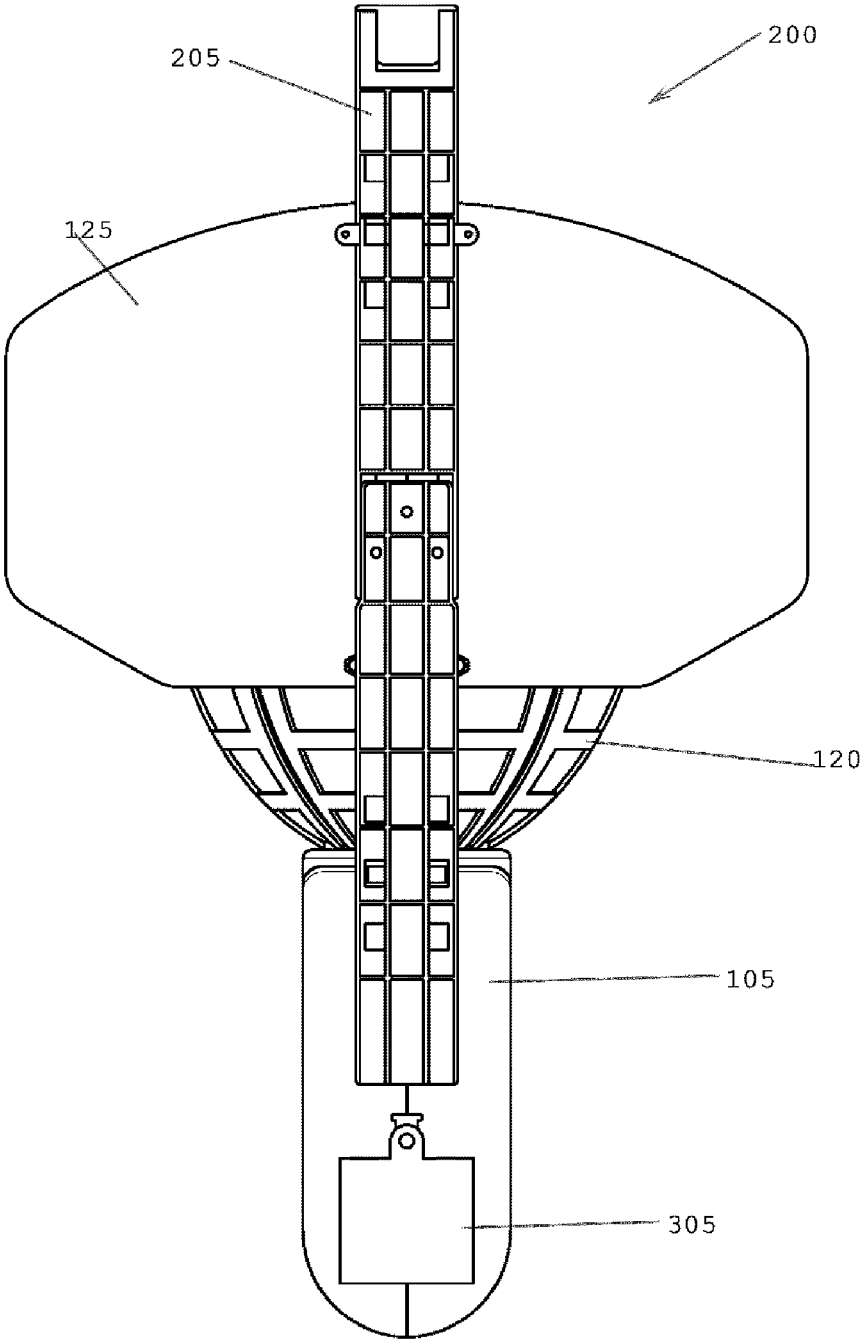
FIG. 3 is a back view of the embodiment of the amusement device shown in FIG. 2.
Figure 4:
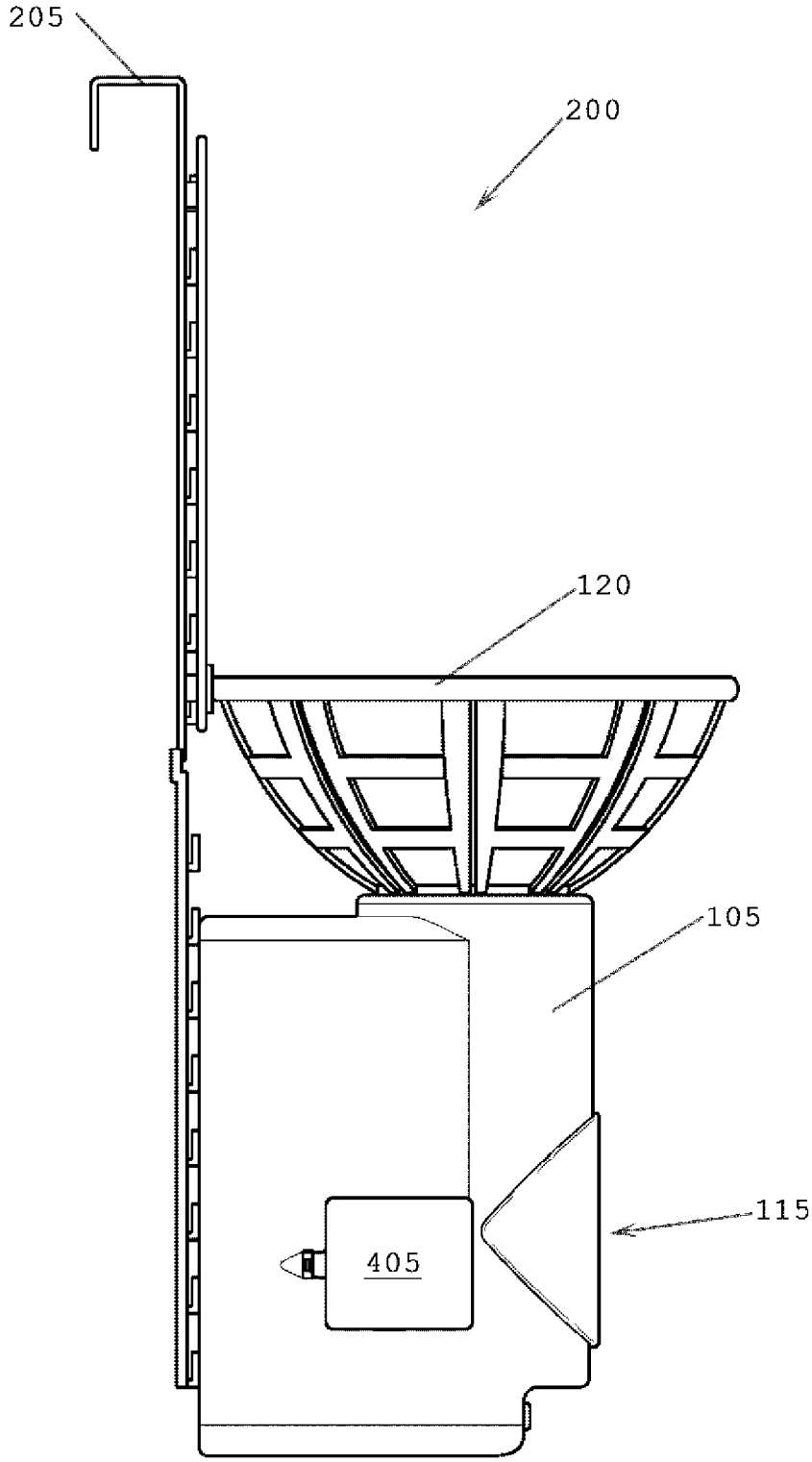
FIG. 4 is a side view of the embodiment of the amusement device shown in FIG. 2.

FIG. 3 is a back view of the embodiment of amusement device 200 shown in FIG. 2. Mounting system 205 is shown in more detail to illustrate the ability to adjust height as desired. Also shown in FIG. 3 is a battery door 305 that permits addition and maintenance of batteries used to power the ejecting system as further described herein. FIG. 4 is a side view of the embodiment of amusement device 200 shown in FIG. 2. Shown in FIG. 4 is an access door 405 that permits a user to clear safety ball 110 from the housing should it become retained within housing 105 and the ejecting system fails to eject it.

Figure 5:
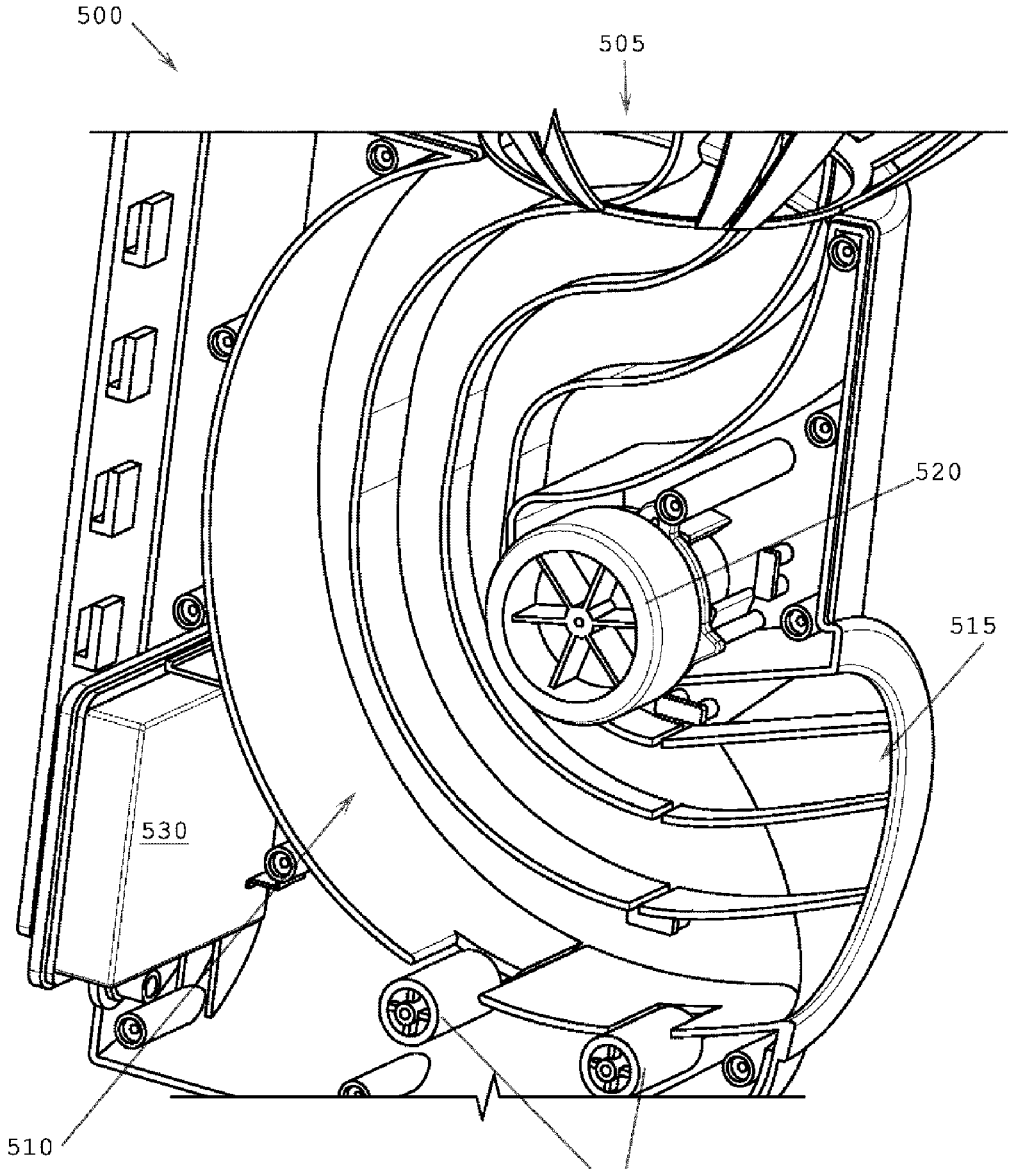
FIG. 5 is an internal cut-away view of the embodiment of the amusement device shown in FIG. 2.

FIG. 5 is an internal cut-away view of a segment 500 of the embodiment of amusement device 200 shown in FIG. 2. Segment 500 includes a top aperture 505 to a ball-directing channel 510 that terminates in an ejecting aperture 515. A battery-powered motorized flywheel 520 operates in cooperation with a roller assembly 525 to eject only a safety ball from aperture 515. Battery compartment 530 is shown for storing the power source for flywheel 520 and any audio/visual effects. Flywheel 520 is mounted in a substantially horizontal portion of channel 510 for improved safety. In this way, flywheel 520 will not eject small objects (e.g., coins and the like) that are dropped into top aperture 505. Only objects substantially sized to the channel diameter will be ejected. Because safety ball 110 is made of soft foam or other similar material that is easily and substantially compressible, ejecting systems may have difficulty ejecting it. The use of the top-mounted flywheel and opposing cooperating roller assembly 525 improve the ability to eject safety ball 110. Safety ball 110 contacts flywheel 520 and roller assembly 525 substantially at the same time to improve the ejecting system's operation and reliability. Some systems may not use the roller assembly.

Embodiments of the present invention may include audio and visual components to improve the gameplay. Sound effects and/or visual effects (collectively effects) may include sports sounds of crowds cheering when safety ball is received into top aperture 505 or other effects coordinated to contact and interaction with system 100/200. That is, effect trigger switch in these implementations would trigger upon receipt of the safety ball into top aperture 505. Additionally there may be guided activities with count-down clock to successfully "make a shot" within a predetermined period.

While the preceding preferably includes mounting system cooperative with a door, the mounting systems could provide for pole or wall mounts for example. Some implementations of the present invention may be used with other types of games without exclusivity to basketball-themed activities.

A motorized basketball toy that features a motorized flywheel auto-return mechanism below the basketball hoop. As the name states the play pattern is that you shoot at the basketball hoop and when you make it in the hoop, the ball will be "shot" back at you relatively quickly allowing you to take your next shot more quickly than existing toy basketball games. This quick return is more convenient and effective way to play than existing toy basketball options which require the player to go and retrieve the ball every time they shoot whether they make it or not. It provides the advantage over existing toy basketball options for practice and training and fun. Toy basketball may either a soft foam, a fabric covered ball with soft filling or a soft blow-molded ball. In all cases soft is king for safety and indoor appropriateness.

One key design feature of the motorized flywheel feature of the invention is that it is located in the TOP of the entrance to the flywheel housing. This provides a safety benefit whereby only the ball designed to be shot out of the motorized housing can be successfully "launched" from the housing. For instance, a penny would just drop down to bottom of the interior housing rather than being shot out which could create a safety hazard to a person in near proximity to the exit hole of the flywheel housing. Another key design feature of the invention is the soft plastic "netting" tapering into the flywheel housing hole which adds a "forgiving" basketball hoop configuration that may more easily receive and guide a ball into the flywheel housing than either a ring without a net or a ring with a more typical nylon net that could be too floppy to guide the ball into the housing as effectively as the soft plastic "netting" provided in the Catch n Shoot design.

The preferred embodiments of the present invention provide a means to adjust the height of the basketball hoop on the back of the door to accommodate a range of skill levels and player sizes. Invention may include both audio and scoring capabilities.

Various components and subsystems of the toy have been described specifically for basketball, the preferred embodiment is not limited to these types of games. Terms specific to the ejecting system have been used. While these are descriptive of the preferred embodiments, these terms are not to be understood as limiting the nature of the present invention.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures may also be implemented in a more separated or integrated manner, or even removed or rendered as inoperable in certain cases, as is useful in accordance with a particular application. It is also within the spirit and scope of the present invention to implement a program or code that may be stored in a machine-readable medium or transmitted using a carrier wave to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

The above-described arrangements of apparatus and methods are merely illustrative of applications of the principles of this invention and many other embodiments and modifications may be made without departing from the spirit and scope of the invention as defined in the claims.

These and other novel aspects of the present invention will be apparent to those of ordinary skill in the art upon review of the drawings and the remaining portions of the specification. Thus, the scope of the invention is to be determined solely by the appended claims.

What is claimed as new and desired to be protected by Letters Patent of the United States is:

1. An amusement system, comprising:

a housing including a receiving aperture at a top surface and an ejecting aperture at a front surface and further including a channel connecting said receiving aperture to said ejecting aperture;

a motorized rotatable flywheel mounted inside said housing and coupled to said channel between said top surface and said channel for engaging an object travelling through said channel;

a roller assembly mounted inside said housing and coupled to said channel opposite of said flywheel and disposed so an object engaging said flywheel concurrently engages said roller assembly wherein said flywheel and said roller assembly cooperatively eject said object a distance less than fifteen feet from said ejecting aperture when said flywheel rotates and contacts said object; and wherein said housing includes a mounting system to attach to an object no less than about three feet above a surface supporting said object.

2. The amusement system of claim 1 further comprising a funneling system generally frustum-shaped having a first base and a second base, said second base having a larger diameter than said first base with said first base coupled to said receiving aperture with a longitudinal aperture extending from said second base to said first base.

3. The amusement system of claim 2 further comprising a backboard coupled to said housing and disposed proximate said second base and extending away from said housing with said funneling system disposed between said backboard and said receiving aperture, said backboard generally planar and extending in a backboard plane with said ejecting aperture defining an ejecting axis generally perpendicular to said backboard plane.

4. The amusement system of claim 2 wherein said funneling system includes a first hoop coupled to said first base, a second hoop coupled to said second base, and a net coupling said first hoop to said second hoop.

5. The amusement system of claim 1 wherein said object is a safety ball.

6. The amusement system of claim 1 wherein said object is ejected from said ejecting aperture after entering said receiving aperture without substantial delay.

7. The amusement system of claim 1 wherein said ejecting aperture ejects said object on an ejecting trajectory wherein said ejecting trajectory does not include any significant upward component.

8. The amusement system of claim 7 wherein said ejecting trajectory includes an ejectment range for said object that does not exceed about ten feet from said housing.

9. The amusement system of claim 1 further comprising:

an audio subsystem for generating a success-themed audio sound; and a sound effect trigger, coupled to said channel, for activating said audio subsystem when said object enters said channel.

10. The amusement system of claim 1 wherein a portion of said channel where said flywheel engages said object is generally horizontal and said flywheel is disposed in an upper surface of said channel.

11. The amusement system of claim 1 wherein said object is ejected from said front surface substantially upon said object entering said channel without a predetermined delay in said ejectment.

12. A method of operating an amusement system, comprising:

a) receiving an object in a receiving aperture disposed in a top surface of a housing with the housing mounted at least about three feet above a playing surface;

b) directing said object into a channel through said housing, said channel coupled to said receiving aperture; and c) ejecting said object from an ejecting aperture disposed in a front surface of said housing an ejecting system including a motorized rotating flywheel and an opposing roller assembly with said flywheel disposed between said channel and said top surface and disposed between said apertures, said flywheel configured to contact said object moving through said channel with said ejecting aperture coupled to said channel;

wherein said flywheel and said roller assembly cooperatively eject said object a distance less than fifteen feet from said ejecting aperture when said flywheel rotates and contacts said object.

13. The method of claim 12 further comprising a funneling system generally frustum-shaped having a first base and a second base, said second base having a larger diameter than said first base with said first base coupled to said receiving aperture with a longitudinal aperture extending from said second base to said first base.

14. The method of claim 13 further comprising a backboard coupled to said housing and disposed proximate said second base and extending away from said housing with said funneling system disposed between said backboard and said receiving aperture, said backboard generally planar and extending in a backboard plane with said ejecting aperture defining an ejecting axis generally perpendicular to said backboard plane.

15. The method of claim 13 wherein said funneling system includes a first hoop coupled to said first base, a second hoop coupled to said second base, and a net coupling said first hoop to said second hoop.

16. The method of claim 12 wherein said object is a safety ball.

17. The method of claim 12 wherein said object is ejected from said ejecting aperture after entering said receiving aperture without substantial delay.

18. The method of claim 12 wherein said ejecting aperture ejects said object on an ejecting trajectory wherein said ejecting trajectory does not include any significant upward component.

19. The method of claim 18 wherein said ejecting trajectory includes an ejectment range for said object that does not exceed about ten feet from said housing.

20. The method of claim 12 further comprising:

an audio subsystem for generating a success-themed audio sound; and a sound effect trigger, coupled to said channel, for activating said audio subsystem when said object enters said channel.

21. The method of claim 12 wherein a portion of said channel where said flywheel engages said object is generally horizontal and said flywheel is disposed in an upper surface of said channel.

22. The method of claim 12 wherein said object is ejected from said front surface substantially upon said object entering said channel without a predetermined delay in said ejectment.

* * * * *